US009956681B2

(12) United States Patent
Kao

(10) Patent No.: US 9,956,681 B2
(45) **Date of Patent: *May 1, 2018**

(54) SLEEVE BRACKET ASSEMBLY

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/586,472

(22) Filed: May 4, 2017

(65) Prior Publication Data

US 2017/0232606 A1 Aug. 17, 2017

Related U.S. Application Data

(63) Continuation-in-part of application No. 15/492,055, filed on Apr. 20, 2017, now abandoned, which is a continuation-in-part of application No. 14/503,676, filed on Oct. 1, 2014.

(51) Int. Cl.

| | |
|---|---|
| ***B25H 3/00*** | (2006.01) |
| ***A47F 7/00*** | (2006.01) |
| ***B25H 3/04*** | (2006.01) |
| ***B25H 3/06*** | (2006.01) |

(52) U.S. Cl.
CPC ..... *B25H 3/003* (2013.01); *B25H 3/04* (2013.01); *B25H 3/06* (2013.01)

(58) Field of Classification Search
CPC ..... B25H 3/06; B25H 3/003; B25H 3/04
See application file for complete search history.

(56) References Cited

U.S. PATENT DOCUMENTS

| | | | | | |
|---|---|---|---|---|---|
| 4,826,021 | A * | 5/1989 | Burrell | B25H 3/003 | 211/70.6 |
| 5,228,570 | A | 7/1993 | Robinson | | |
| 5,715,951 | A * | 2/1998 | Dembicks | B25H 3/06 | 206/378 |
| 5,725,107 | A * | 3/1998 | Dembicks | B25H 3/06 | 206/378 |
| 5,855,284 | A * | 1/1999 | Dembicks | B25H 3/06 | 206/378 |
| 5,897,001 | A * | 4/1999 | Dembicks | B25B 13/56 | 206/378 |
| 6,095,329 | A * | 8/2000 | Kao | B25H 3/003 | 206/378 |

(Continued)

FOREIGN PATENT DOCUMENTS

| | | | |
|---|---|---|---|
| AU | 2014203323 | A1 | 12/2015 |
| CN | 101407057 | A | 4/2009 |

(Continued)

*Primary Examiner* — Daniel J Troy
*Assistant Examiner* — Kimberley S Wright
(74) *Attorney, Agent, or Firm* — Alan D. Kamrath; Kamrath IP Lawfirm, P.A.

(57) ABSTRACT

A sleeve bracket assembly includes a rail base, a positioning board and multiple positioning mounts. The rail base includes two side boards and a connecting seat connecting with the side boards. Each side board has a sliding rail protruding from an inner surface of the side boards. The positioning board is integrally formed with the sliding rail. The positioning mounts are rotatably and movably mounted in the rail base and abut the positioning board. The positioning mounts are positioned between the positioning board and the rail base. When no external force is applied, the positioning mounts will not move or rotate.

10 Claims, 14 Drawing Sheets

(56) References Cited

U.S. PATENT DOCUMENTS

| | | | | |
|---|---|---|---|---|
| 6,386,363 | B1 * | 5/2002 | Huang | B25H 3/003 206/1.5 |
| 6,431,373 | B1 * | 8/2002 | Blick | B25H 3/003 206/378 |
| 6,488,151 | B2 | 12/2002 | Ramsey et al. | |
| 7,717,278 | B2 | 5/2010 | Kao | |
| 7,841,480 | B2 * | 11/2010 | Hsieh | B25H 3/06 206/378 |
| 8,733,562 | B2 | 5/2014 | Kao | |
| 8,813,957 | B1 | 8/2014 | Kao | |
| 8,955,698 | B2 * | 2/2015 | Hsieh | B25H 3/04 206/378 |
| 9,126,329 | B2 * | 9/2015 | Kao | B25H 3/04 |
| 9,186,790 | B1 * | 11/2015 | Kao | B25H 3/06 |
| 9,452,524 | B1 * | 9/2016 | Kao | B25H 3/04 |
| 9,522,467 | B1 * | 12/2016 | Kao | A47F 7/0028 |
| 9,527,206 | B1 * | 12/2016 | Hsieh | B25H 3/003 |
| 9,539,721 | B1 * | 1/2017 | Kao | B25H 3/04 |
| 9,545,716 | B2 * | 1/2017 | Hsieh | B25H 3/04 |
| 9,656,385 | B1 * | 5/2017 | Kao | B25H 3/04 |
| 9,662,781 | B1 * | 5/2017 | Kao | B25H 3/003 |
| 2005/0218023 | A1 * | 10/2005 | Winnard | B25H 3/003 206/378 |
| 2005/0221664 | A1 * | 10/2005 | Winnard | B25H 3/003 439/510 |
| 2010/0065520 | A1 | 3/2010 | Hsieh | |
| 2011/0089126 | A1 * | 4/2011 | Hsieh | B25H 3/003 211/70.6 |
| 2012/0138553 | A1 | 6/2012 | Kao | |
| 2012/0152871 | A1 | 6/2012 | Kao | |
| 2013/0062480 | A1 * | 3/2013 | Kao | B25H 3/04 248/201 |
| 2015/0122750 | A1 * | 5/2015 | Kao | B25H 3/04 211/13.1 |
| 2015/0336262 | A1 * | 11/2015 | Kao | B25H 3/06 206/378 |
| 2016/0096264 | A1 * | 4/2016 | Kao | B25H 3/06 206/378 |
| 2016/0221178 | A1 * | 8/2016 | Hsieh | B25H 3/04 |

FOREIGN PATENT DOCUMENTS

| | | | |
|---|---|---|---|
| FR | 2997030 | A1 | 4/2014 |
| GB | 2507040 | A | 4/2014 |
| JP | 10-71583 | | 3/1998 |
| JP | 2012152842 | A | 8/2012 |
| JP | 2014083634 | A | 5/2014 |
| TW | I283629 | B | 7/2007 |
| TW | I346607 | B | 8/2011 |
| TW | I365802 | B | 6/2012 |
| TW | I380886 | A | 1/2013 |
| TW | I395647 | B | 5/2013 |
| TW | I404658 | B | 8/2013 |
| TW | I409150 | B | 9/2013 |

* cited by examiner

SLEEVE BRACKET ASSEMBLY

The present invention is a continuation-in-part of application Ser. No. 14/503,676, filed on Oct. 1, 2014.

BACKGROUND OF THE INVENTION

1. Field of the Invention

The present invention relates to a hand tool assembly and, more particularly, to a sleeve bracket assembly.

2. Description of Related Art

A conventional sleeve bracket assembly has a rail base and multiple positioning mounts slidably mounted on the rail base. The positioning mounts are used to hold hex sockets to allow a user to look for the marks of sizes or model numbers on outer peripheries of the hex sockets by rotating. To move or rotate the hex sockets easily and quickly, the rail base is not set up with any fixing structure for fixing the positioning mounts. Hence, the positioning mounts may be moved or rotated by impact or when hit by an unexpected force, such that the user has to frequently and repeatedly look for the marks of sizes or model numbers of the hex sockets, which is very inconvenient in use.

To overcome the shortcomings of the conventional rail base and positioning mounts, the present invention provides a sleeve bracket assembly to mitigate or obviate the aforementioned problems.

SUMMARY OF THE INVENTION

In order to reach the invention objective, the present invention provides a sleeve bracket assembly that includes a rail base, a positioning board and multiple positioning mounts. The rail base includes two side boards and a connecting seat connecting with the side boards. Each side board has a sliding rail protruding from an inner surface of the side boards. The positioning board is integrally formed with the sliding rail. The positioning mounts are rotatably and movably mounted in the rail base and abut the positioning board. The positioning mounts are positioned between the positioning board and the rail base. When no external force is applied, the positioning mounts will not move or rotate.

Other objectives, advantages, and novel features of the invention will become more apparent from the following detailed description when taken in conjunction with the accompanying drawings.

DETAILED DESCRIPTION OF PREFERRED EMBODIMENTS

Figure 1:
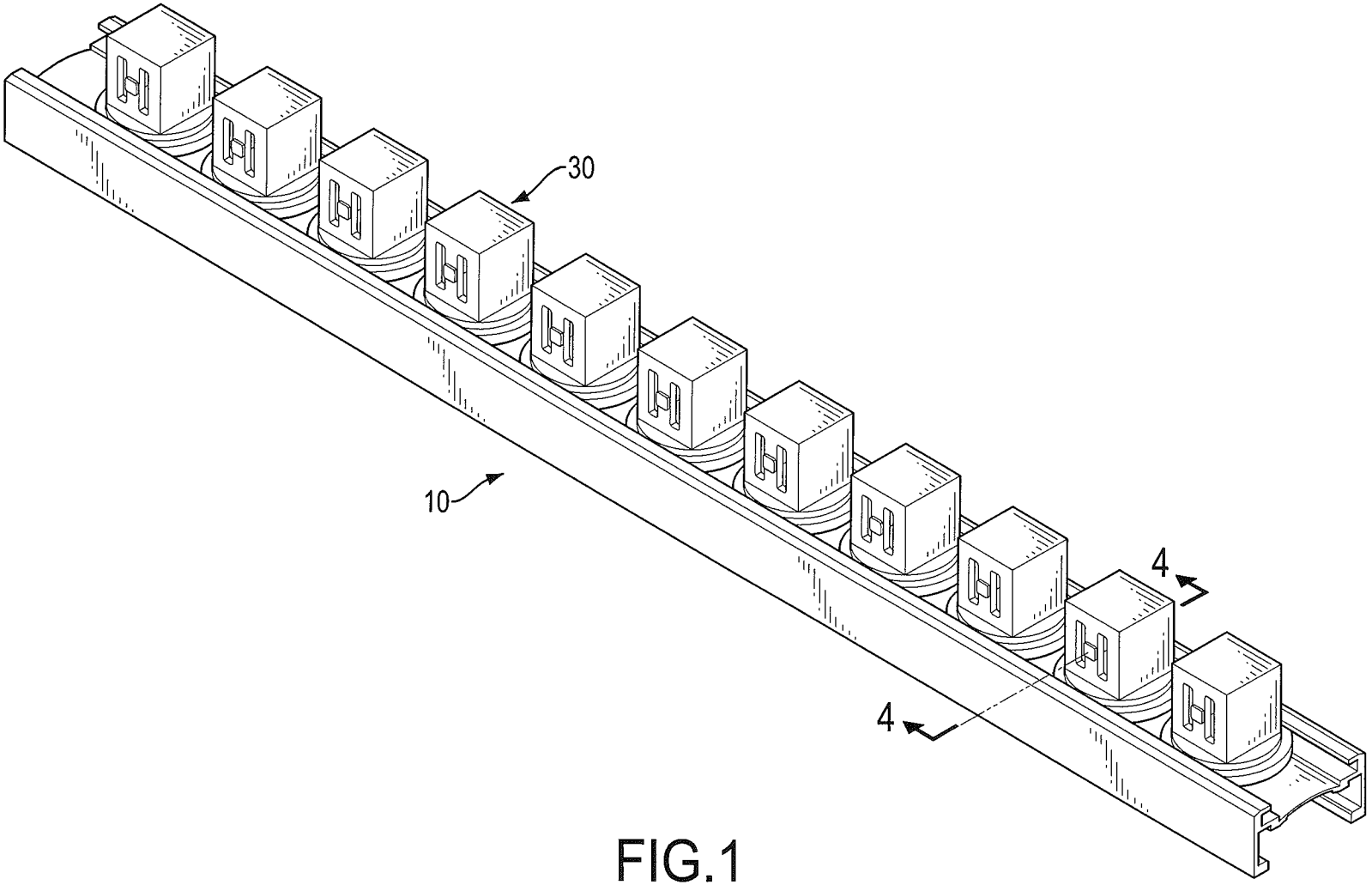
FIG. 1 is a perspective view of a first embodiment of a sleeve bracket assembly in accordance with the present invention.

With reference to FIGS. 1 to 5, a first preferred embodiment of a sleeve bracket assembly includes a rail base 10, a positioning board 20 and multiple positioning mounts 30.

The rail base 10 can be made of an elastic material or a rigid material, and preferably, may be an aluminum extrusion structure or a plastic injection structure. The rail base 10 is an aluminum extrusion structure and includes two side boards 11 and a connecting seat connecting with the side boards 11. The side boards 11 are disposed vertically at an interval and have two sliding rails 111, a sliding channel 112, an opening 113, and a notch 114. The sliding rails 111 respectively protrude from inner surfaces of the side boards 11 and face each other. Each sliding rail 111 has an upper abutment surface 1110 and a lower abutment surface 1113 defined respectively at an upper side and a lower side of the sliding rail 111. The sliding channel 112 is formed between inner surfaces of the sliding rails 111 and extends along an axis of the rail base 10. The opening 113 is formed in tops of the side boards 11 of the rail base 10 and communicates with the sliding channel 112. The notch 114 is formed between the sliding rails 111 and communicates with the sliding channel 112 and the opening 113.

Figure 2:
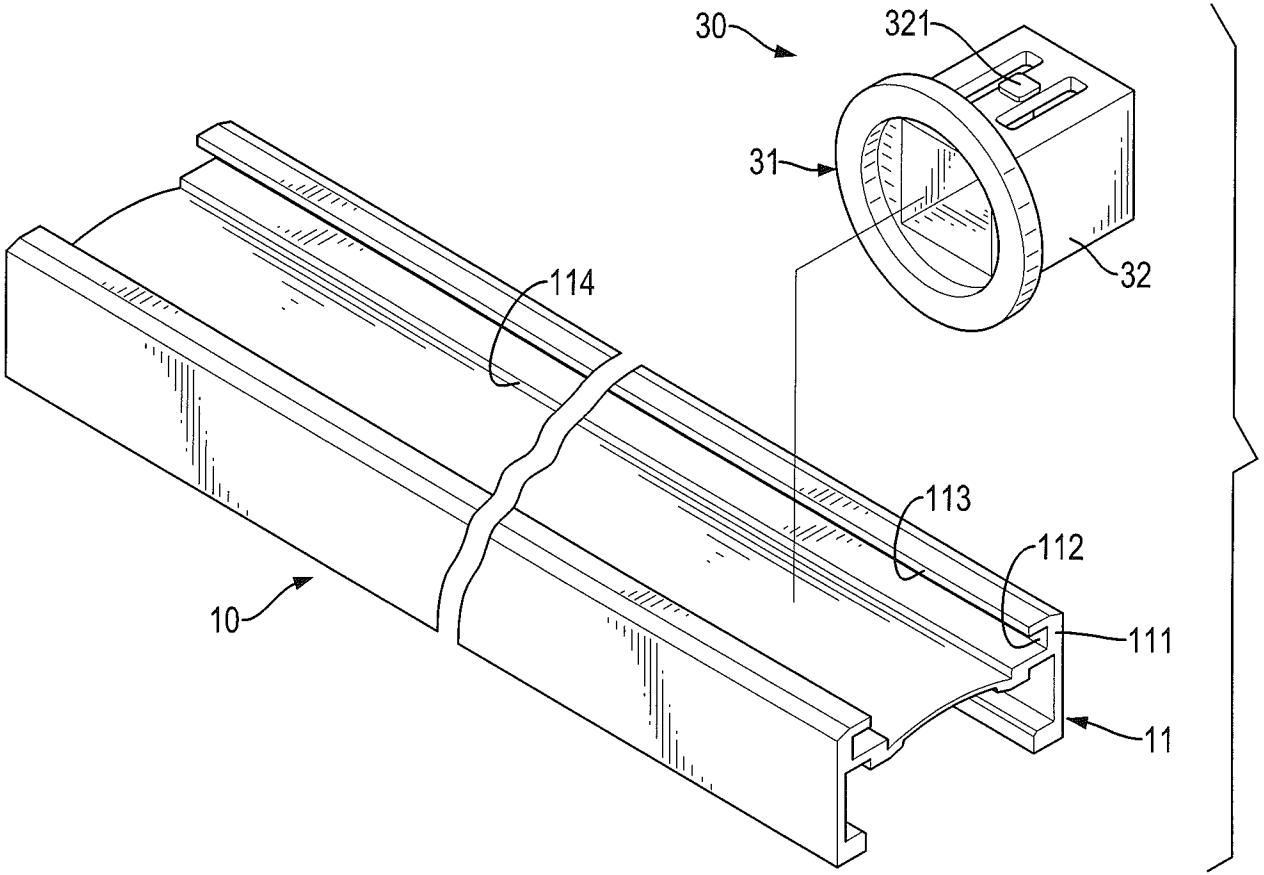
FIG. 2 is an enlarged exploded perspective view of the first embodiment of the sleeve bracket assembly in FIG. 1.
Figure 3:
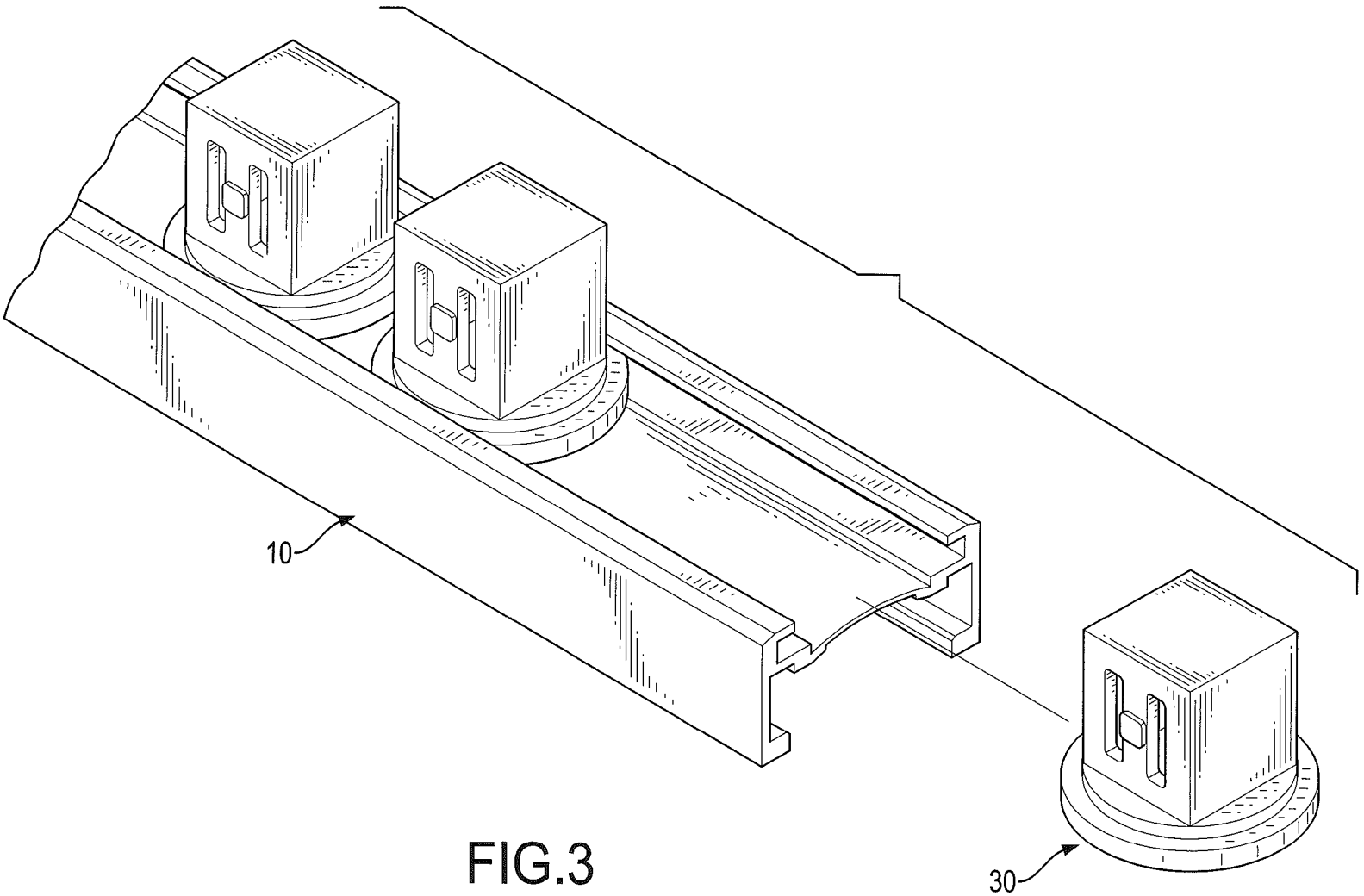
FIG. 3 is another enlarged exploded perspective view of the first embodiment of the sleeve bracket assembly in FIG. 1.
Figure 4:
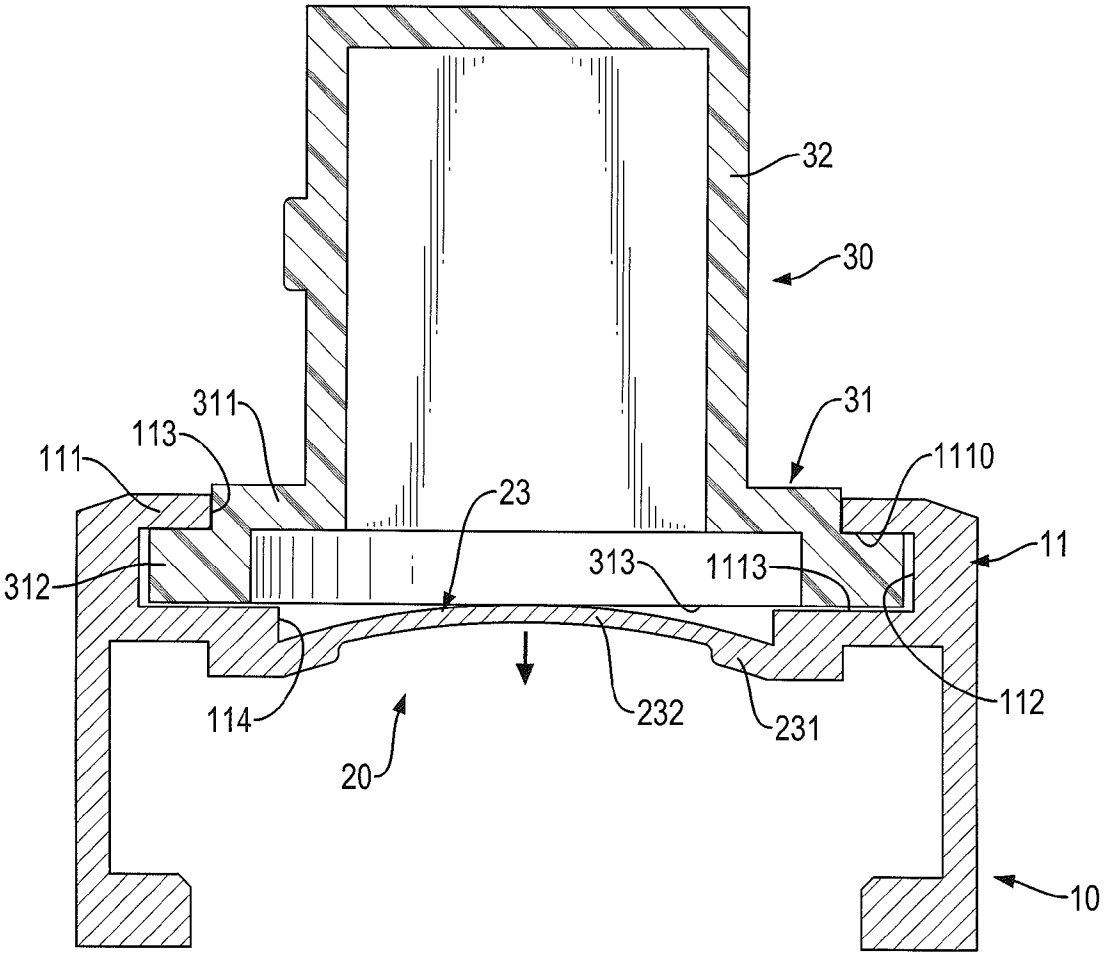
FIG. 4 is an enlarged side view in partial section of the first embodiment of the sleeve bracket assembly along line 4-4 in FIG. 1.

With reference to FIGS. 2 to 4, the positioning board 20 is integrally formed with the sliding rail 111, is an elongated strip and extends along the axis of the rail base 10. Preferably, the positioning board 20 is made by an aluminum extrusion. The positioning board 20 has an abutment portion 23. The abutment portion 23 protrudes upwardly from a central portion of the positioning board 20, protrudes into the sliding channel 112 via the notch 114, extends longitudinally along the positioning board 20, and is shaped as a bulge protruding on a central portion of the abutment portion 23 and gradually inclining towards two sides of the bulge. Preferably, the abutment portion 23 has a pair of connecting portions 231 and an elastic portion 232 connected between the pair of connecting portions 231. The thickness of each one of the pair of connecting portions 231 is larger than the thickness of the elastic portion 232. An uppermost point of the abutment portion 23 is located above the lower abutment surfaces 1113 of the sliding rails 111.

Figure 5:
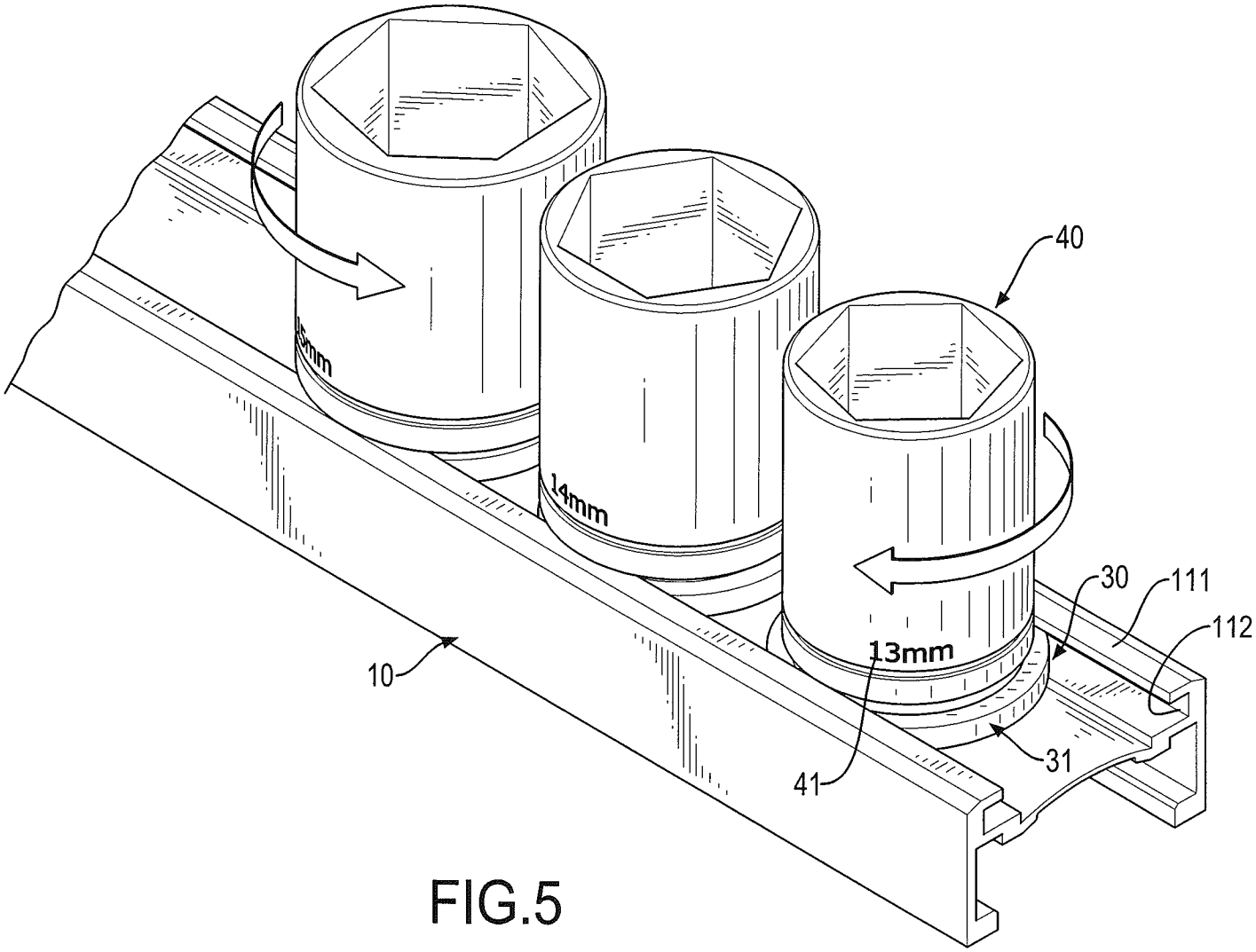
FIG. 5 is an enlarged operational perspective view of the first embodiment of the sleeve bracket assembly in FIG. 1.

With reference to FIGS. 2, 3 and 5, the positioning mounts 30 are rotatably and movably mounted in the sliding channel 112 of the rail base 10. The positioning mounts 30 are rotated unrestrictedly relative to the abutment portion and have at least one linear contact with the abutment portion 23 for rotating easily during moving.

The positioning mounts 30 can be made of an elastic material or a rigid material. When the rail base 10 is made of an elastic material, the positioning mounts 30 are made of a rigid material. One of the rail base 10 and each positioning mount 30 is made of an elastic material, and the other one of the rail base 10 and each positioning mount 30 is made of a rigid material. Preferably, each positioning mount 30 is made of a plastic material and includes a sliding portion 31 and a socket portion 32 and is slidably engaged in the sliding channel 112 by the sliding portion 31.

The sliding portion 31 can be a round or stepped plate. Preferably, the sliding portion 31 is a double-stepped round plate, which is divided as an upper step 311 and a lower step 312. A diameter of the lower step 312 is larger than a diameter of the upper step 311. The diameter of the lower step 312 is smaller than a horizontal width of the sliding channel 112. The diameter of the upper step 311 is smaller than the horizontal width of the opening 113. An abutment surface 313 is formed on a bottom of the sliding portion 31 and is flat and annular.

The socket portion 32 is rectangular in cross-section and is integrally formed on a top surface of the upper step 311 and has a positioning protrusion 321 formed on a side surface of the socket portion 32 at a radial direction of the socket portion 32 for mounting a hex socket or other hand tools.

Figure 6:
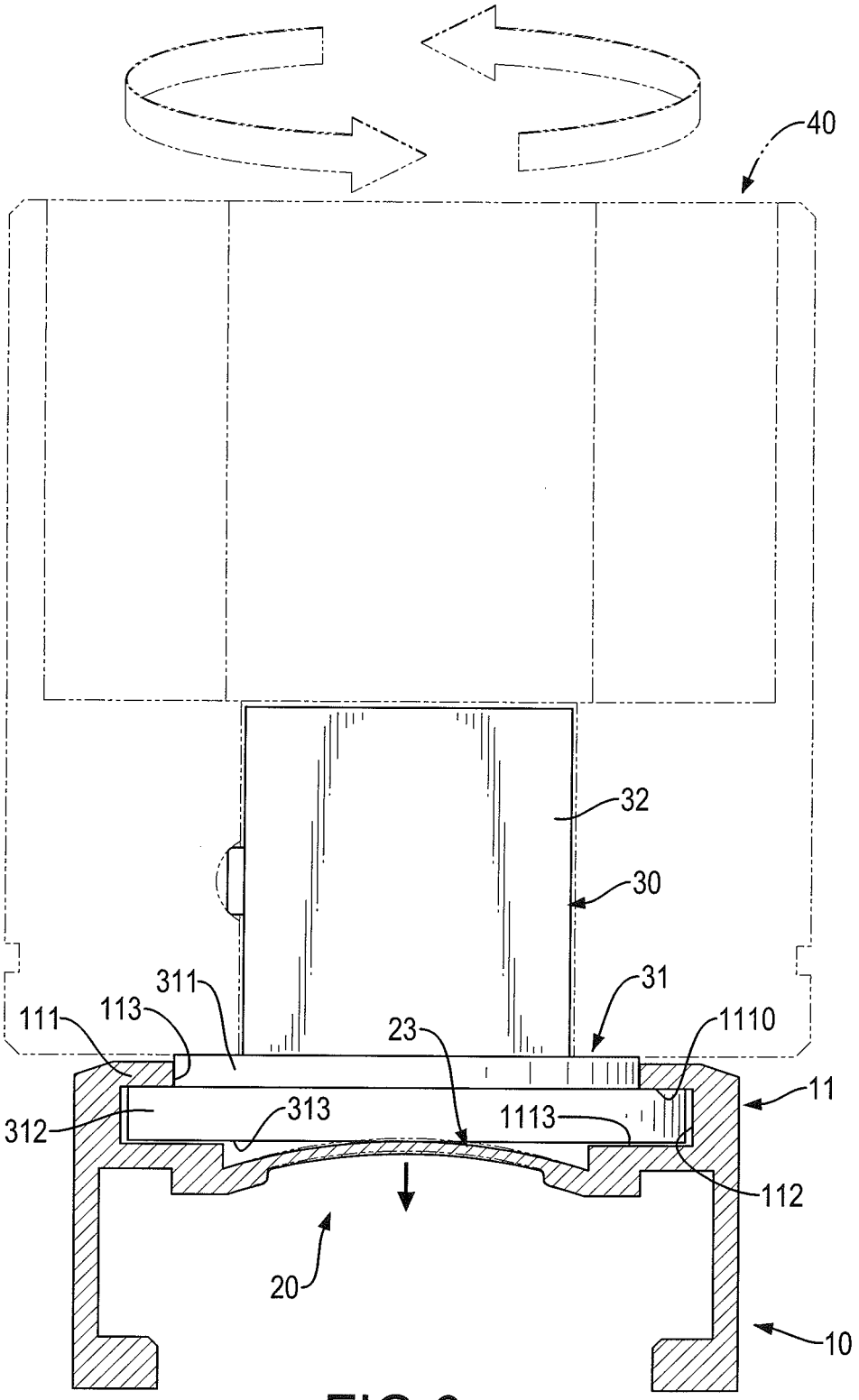
FIG. 6 is an operational side view in partial section of the first embodiment of the sleeve bracket assembly in FIG. 5.

With reference to FIGS. 5 and 6, multiple hex sockets 40 are respectively mounted on the positioning mounts 30, and each hex socket 40 has an indication sign 41 mounted in an outer periphery of the hex socket 40 to allow a user to rotate the positioning mounts 30 for recognizing the size or model number of the hex socket 40. The positioning mounts 30 are mounted in the sliding channel 112 by the sliding portion 31, the abutment surface 313 of each positioning mount 30 abuts the abutment portion 23 of the positioning board 20, and a top surface of the lower step 312 of each positioning mount 30 abuts the upper abutment surfaces 1110 of the sliding rails 111. Hence, the positioning mounts 30 are positioned on the positioning board 20 and the rail base 10 to maintain a three-point contact.

When the user wants to rotate or move the hex sockets 40, the positioning mounts 30 must be pressed or be applied with a vertical or horizontal force to separate the positioning mounts 30 slightly from the sliding rails 111. Otherwise, the positioning mounts 30 are fixed between the positioning board 20 and the rail base 10 and will not move or rotate except when being applied with external forces.

Therefore, the rail base 10 and the positioning board 20 are formed integrally as a single part to save material and to reduce cost in manufacture, and a space for a connecting seat is unnecessary.

Figure 7:
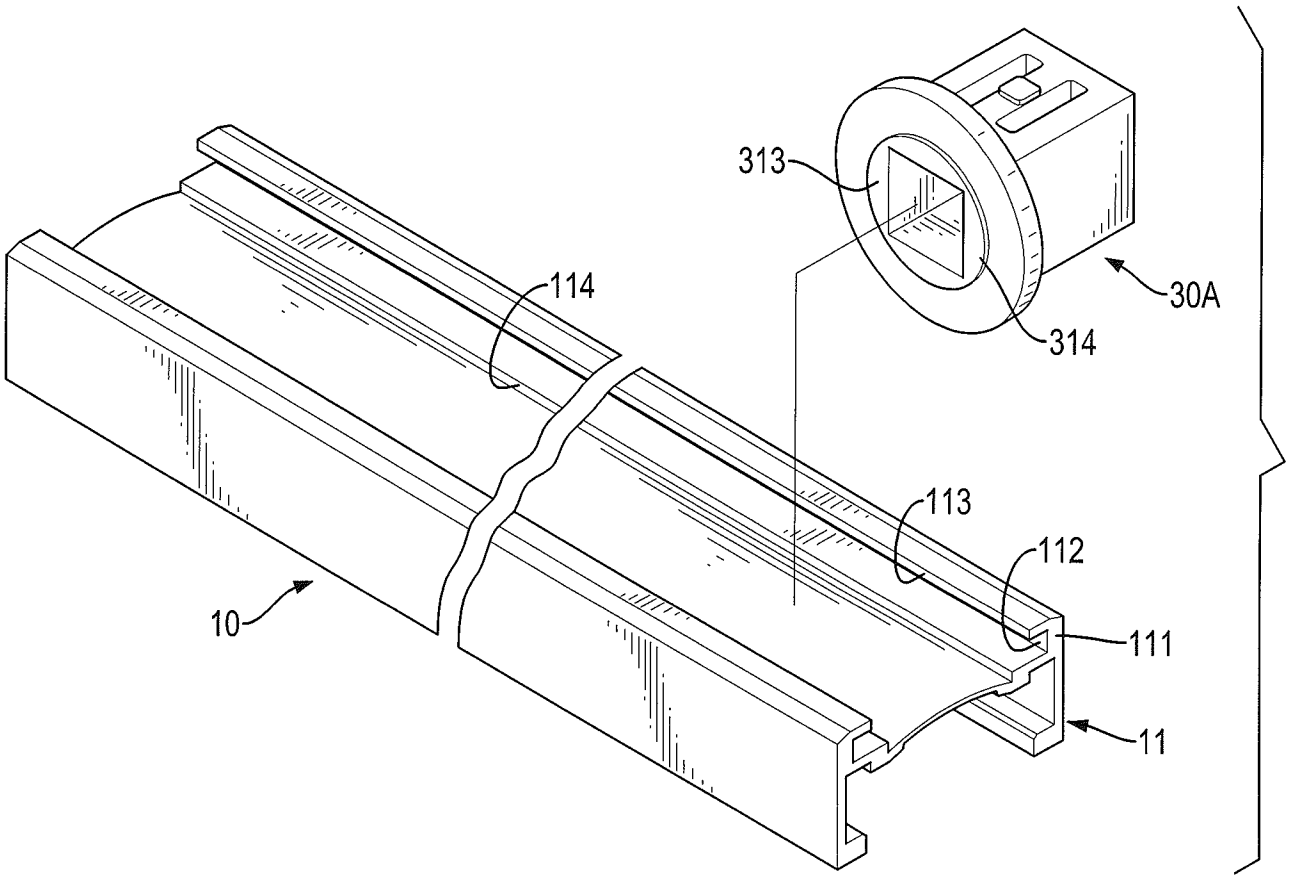
FIG. 7 is an exploded perspective view of a second embodiment of a sleeve bracket assembly in accordance with the present invention.
Figure 8:
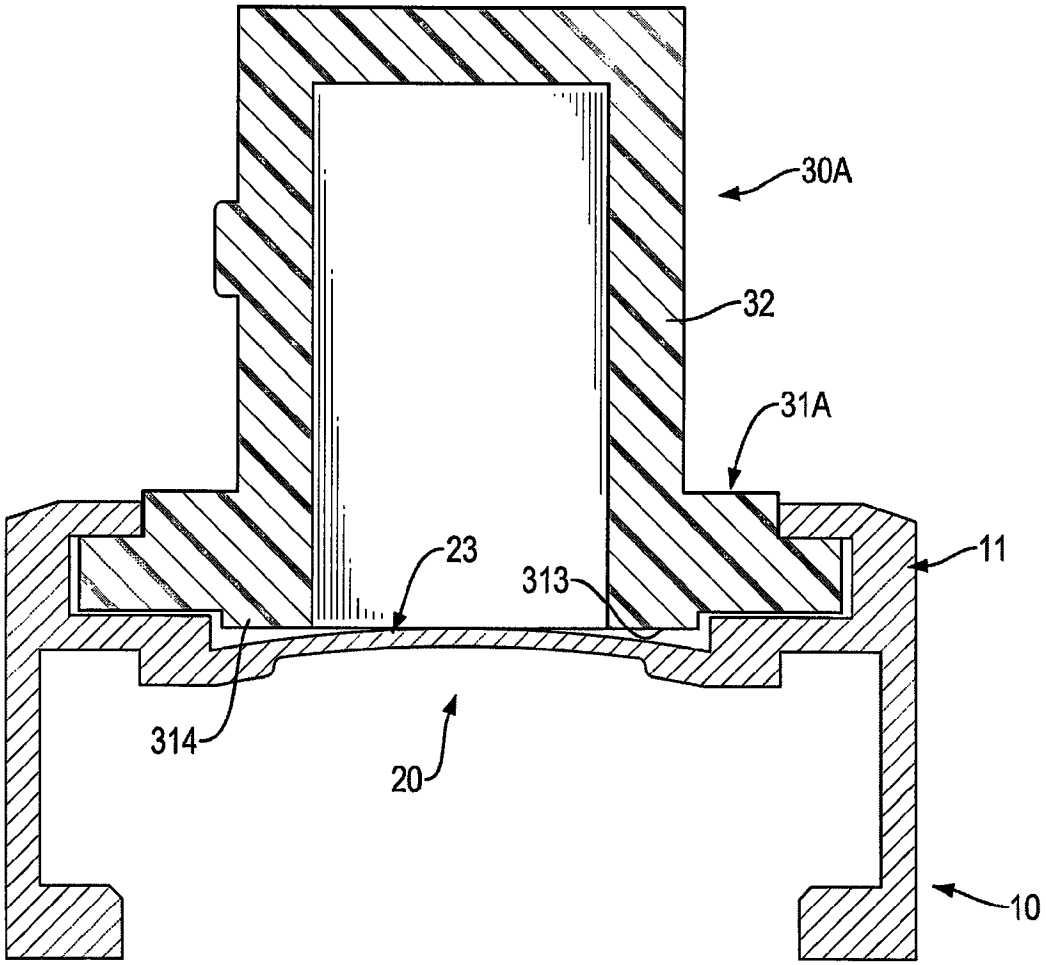
FIG. 8 is a cross-sectional side view of the second embodiment of the sleeve bracket assembly in FIG. 7.

Therefore, the user can easily and quickly find the indication signs 41 of the hex sockets 40 without moving or rotating the hex sockets 40 repeatedly to save a lot of time for finding a correct hex socket 40. With reference to FIGS. 7 and 8, in a second preferred embodiment of the sleeve bracket assembly in accordance with the present invention, the elements and effects of the second embodiment are the same as those of the first embodiment except the shape of the positioning mounts 30A.

With reference to FIGS. 7 and 8, each positioning mount 30A has a protrusion 314 formed on the bottom of the sliding portion 31A, and the abutment surface 313 is defined on a bottom surface of the protrusion 314. The abutment surface 313 of each positioning mount 30A abuts the abutment portion 23 of the positioning board 20.

Figure 9:
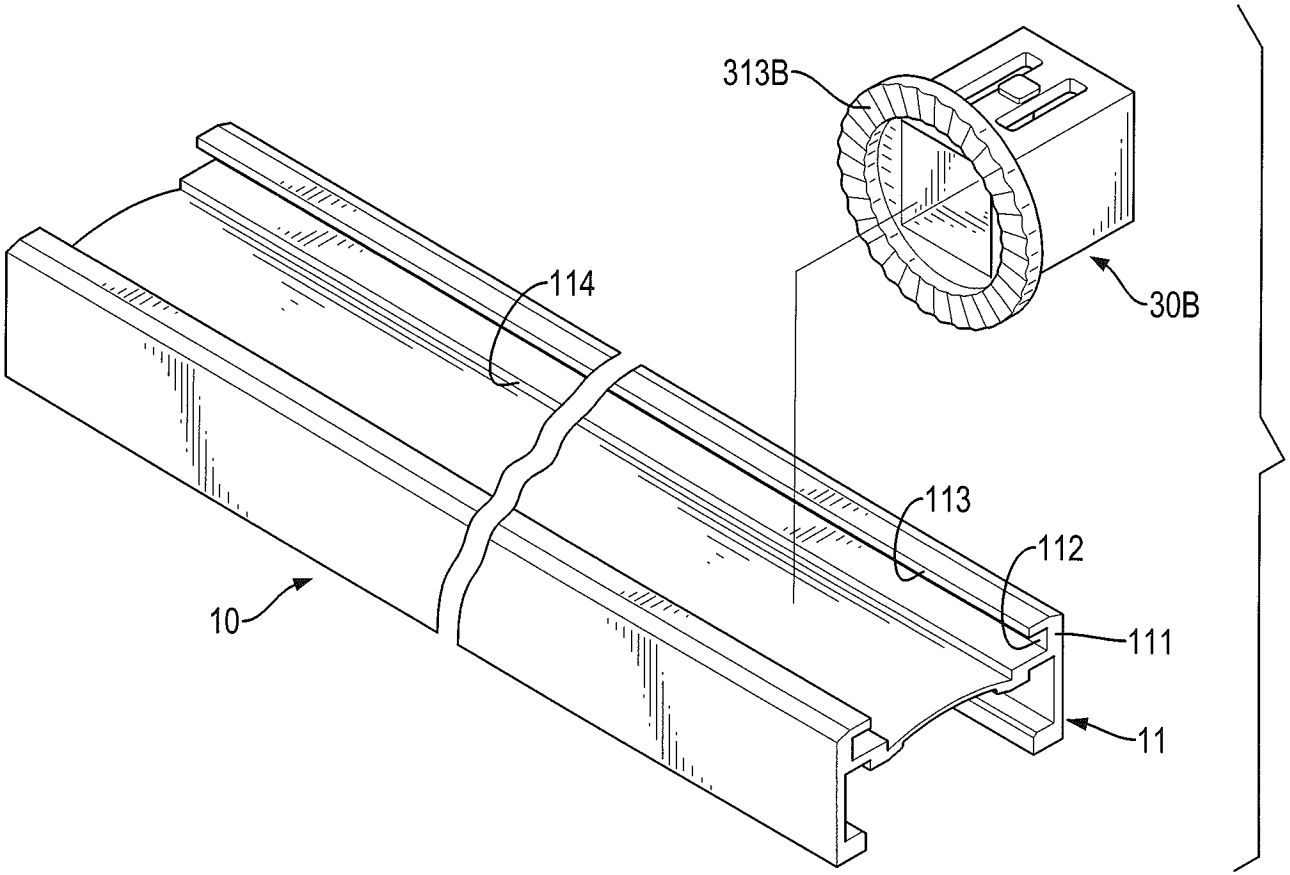
FIG. 9 is an exploded perspective view of a third embodiment of a sleeve bracket assembly in accordance with the present invention.

With reference to FIG. 9, in a third preferred embodiment of the sleeve bracket assembly in accordance with the present invention, the elements and effects of the third embodiment are the same as those of the first embodiment except the shape of the positioning mounts 30B. The abutment surface 313B of the positioning mount 30B is wave-shaped, forming gentle arcs with concave and convex portions to increase friction and to improve the positioning effects between the abutment surface 313B and the positioning board 20.

Figure 10:
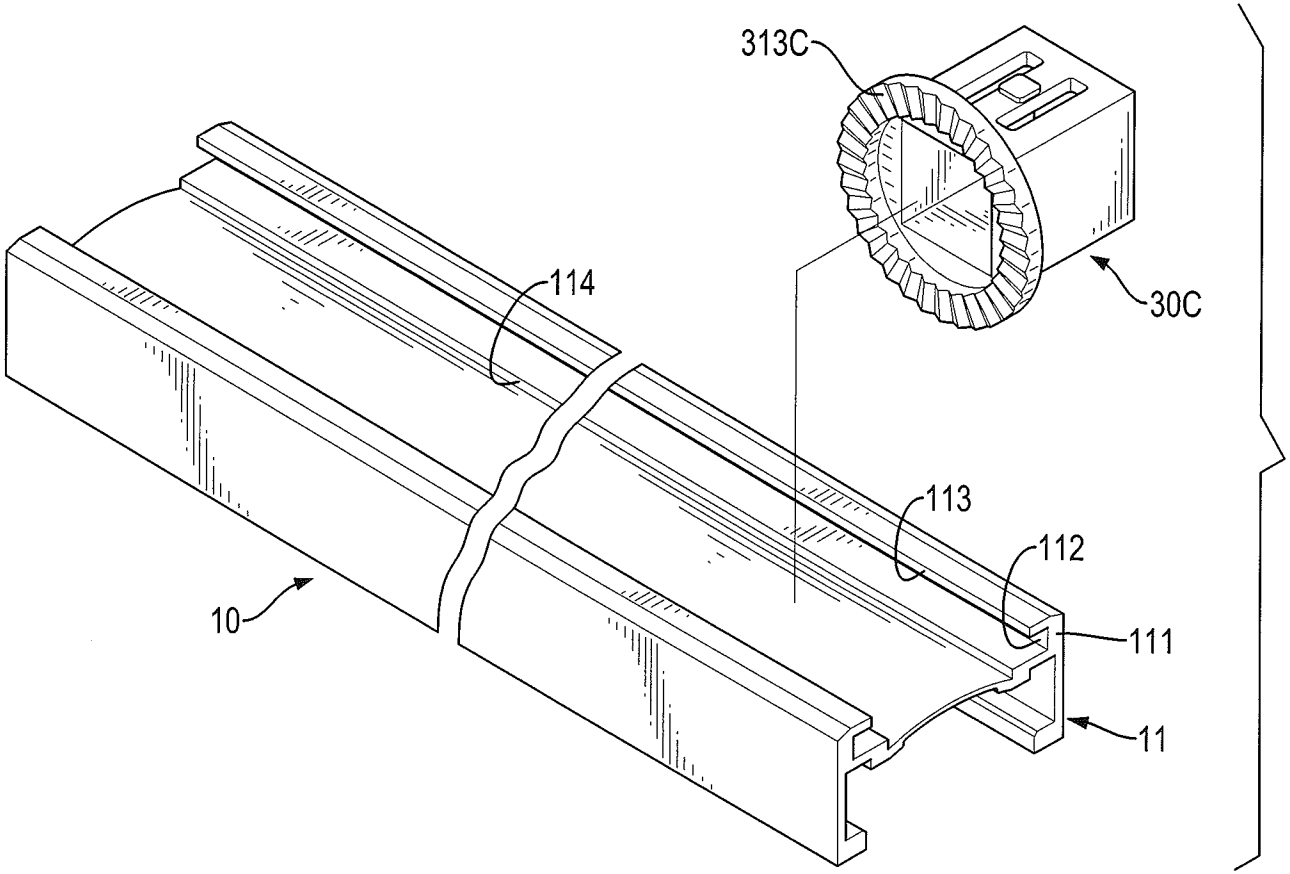
FIG. 10 is an exploded perspective view of a fourth embodiment of a sleeve bracket assembly in accordance with the present inventions.

With reference to FIG. 10, in a fourth preferred embodiment of the sleeve bracket assembly in accordance with the present invention, the elements and effects of the fourth embodiment are the same as those of the first embodiment except the shape of the positioning mounts 30C. The abutment surface 313C of the positioning mount 30C is sharply toothed, forming concave and convex portions to increase friction and to improve the positioning effects between the abutment surface 313C and the positioning board 20.

Figure 11:
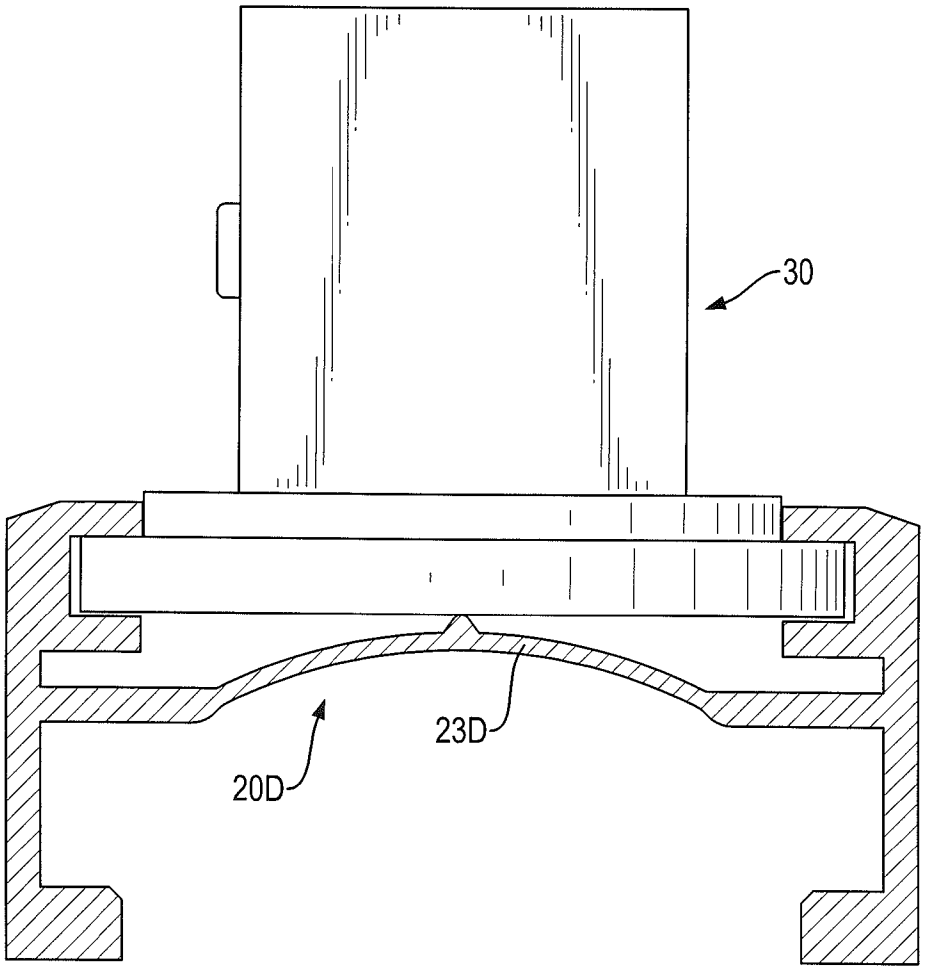
FIG. 11 is a side view in partial section of a fifth embodiment of a sleeve bracket assembly in accordance with the present invention.

With reference to FIG. 11, in a fifth preferred embodiment of the sleeve bracket assembly in accordance with the present invention, the elements and effects of the fifth embodiment are the same as those of the first embodiment except the shape of the positioning board 20D. The abutment portion 23D of the positioning board 20D has a bow-shaped section and a rib protruding upwardly from a middle of the bow-shaped section of the positioning board 20D.

Figure 12:
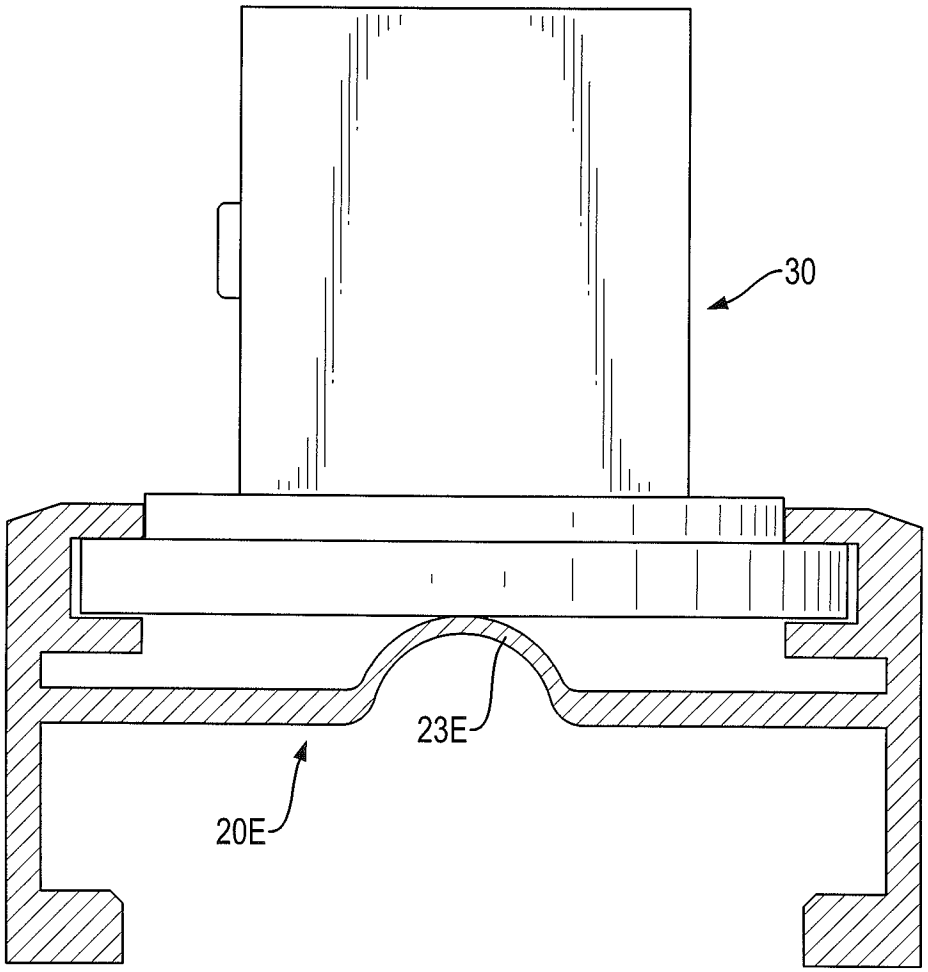
FIG. 12 is a side view in partial section of a sixth embodiment of a sleeve bracket assembly in accordance with the present invention.
Figure 13:
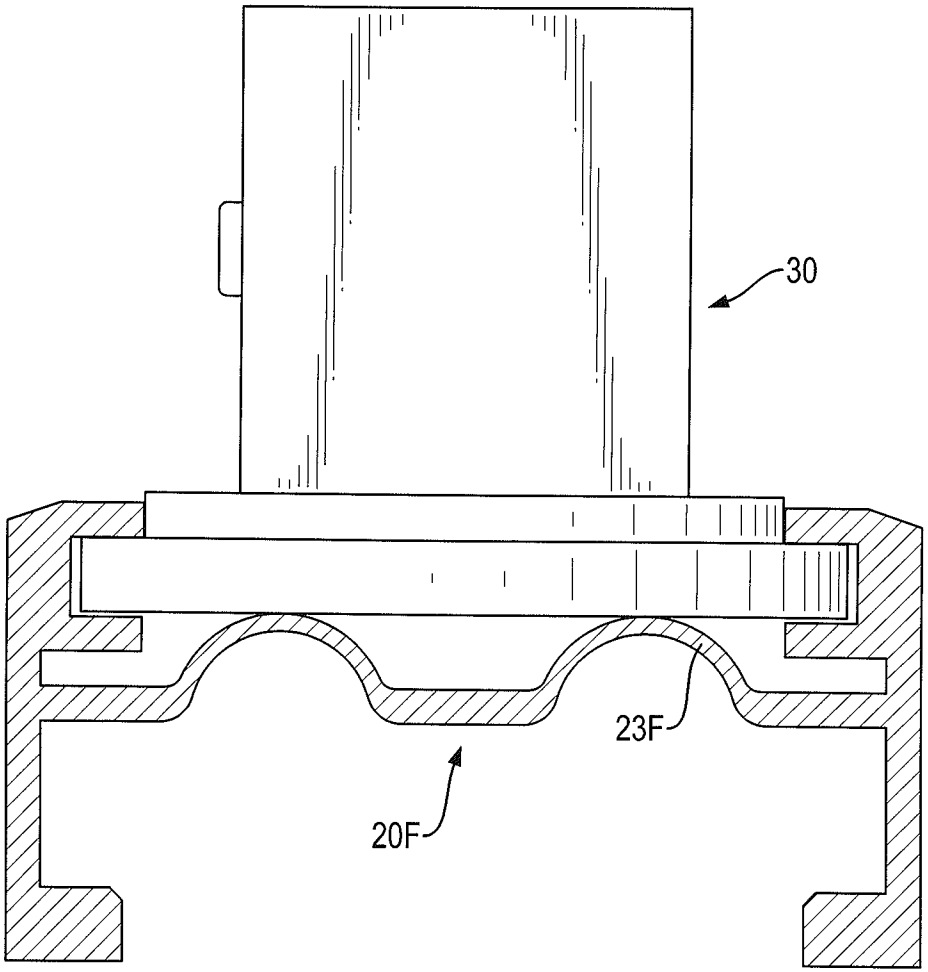
FIG. 13 is a side view in partial section of a seventh embodiment of a sleeve bracket assembly in accordance with the present invention.
Figure 14:
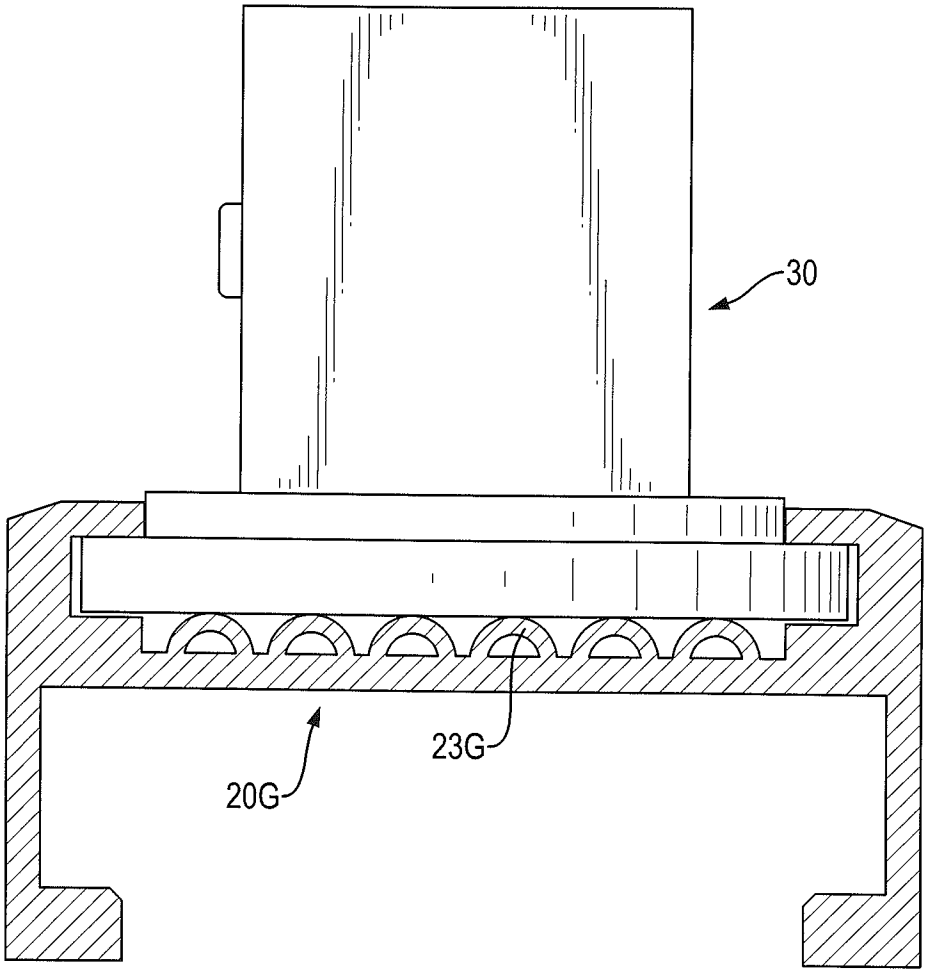
FIG. 14 is a side view in partial section of an eighth embodiment of a sleeve bracket assembly in accordance with the present invention.

With reference to FIGS. 12 to 14, in sixth, seventh and eighth preferred embodiments of the sleeve bracket assembly in accordance with the present invention, the elements and effects of the sixth, seventh and eighth embodiments are the same as those of the first embodiment except the shape of the positioning board 20E, 20F, 20G. The positioning mounts 30 are rotatably and freely moved relative to the positioning board 20E, 20F, 20G.

With reference to FIG. 12, the abutment portion 23E of the positioning board 20E has a U-shaped section protruding upwardly from a middle of the positioning board 20E.

With reference to FIG. 13, the abutment portion 23F of the positioning board 20F has two U-shaped sections protruding upwardly at intervals from a middle of the positioning board 20F.

With reference to FIG. 14, the abutment portion 23G of the positioning board 20G has multiple U-shaped sections protruding upwardly at intervals and disposed transversely along the positioning board 20G.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sleeve bracket assembly comprising:

a rail base including:

two side boards extending in a direction, being parallel to each other, and disposed vertically at an interval and having:

two sliding rails respectively protruding from inner surfaces of the two side boards and facing each other;

a sliding channel formed between the inner surfaces of the two sliding rails; and a notch formed between the two sliding rails and communicating with the sliding channel;

a positioning board being an elongated strip, integrally connecting with bottoms of the sliding rails, and having an abutment portion having a curved cross section perpendicular to the direction and protruding upwardly and protruding into the sliding channel via the notch, with the abutment portion having a constant vertical thickness inside the notch; and multiple positioning mounts movably mounted in the sliding channel of the rail base and unrestrictedly rotatable relative to the abutment portion, with each positioning mount including:

a sliding portion having an abutment surface formed on a bottom of the sliding portion; and a socket portion integrally formed on a top surface of the sliding portion, wherein the multiple positioning mounts are mounted in the sliding channel by the sliding portion, wherein the abutment surfaces of the multiple positioning mounts abut the abutment portion of the positioning board, and wherein the sliding portions of the multiple positioning mounts abut inner sides of the two sliding rails.

2. The sleeve bracket assembly as claimed in claim 1, wherein each sliding rail has a lower abutment surface defined at a lower side inside the sliding rail, wherein the abutment portion is shaped as a bulge protruding in a central portion of the abutment portion and gradually inclined toward two sides of the bulge, and wherein an uppermost point of the abutment portion is located above the lower abutment surface of the sliding rail.

3. The sleeve bracket assembly as claimed in claim 2, wherein each positioning mount has a protrusion formed on the bottom of the sliding portion, and wherein the abutment surface of each positioning mount is defined on a bottom surface of the protrusion of the positioning mount.

4. The sleeve bracket assembly as claimed in claim 1, wherein the shape of the abutment surface of the positioning mount is flat.

5. The sleeve bracket assembly as claimed in claim 2, wherein the shape of the abutment surface of the positioning mount is flat.

6. The sleeve bracket assembly as claimed in claim 3, wherein the shape of the abutment surface of the positioning mount is flat.

7. The sleeve bracket assembly as claimed in claim 1, wherein one of the rail base and each positioning mount is made of an elastic material, and wherein another one of the rail base and each positioning mount is made of a rigid material.

8. The sleeve bracket assembly as claimed in claim 1, wherein the abutment portion of the positioning board has at least one U-shaped section protruding upwardly from a middle of the positioning board.

9. The sleeve bracket assembly as claimed in claim 8, wherein the abutment portion of the positioning board has two U-shaped sections protruding upwardly from the positioning board at an interval.

10. The sleeve bracket assembly as claimed in claim 1, wherein the abutment portion of the positioning board has multiple U-shaped sections protruding upwardly from the positioning board at an interval and disposed transversely along the positioning board.

* * * * *